United States Patent [19]

Sanborn, Jr. et al.

[11] 4,058,953

[45] Nov. 22, 1977

[54] GAS FLUSHING OR FILLING PACKAGING MACHINE

[75] Inventors: Philip A. Sanborn, Jr., Spartanburg, S.C.; Shelby F. Westbrook, Chicago; Donald A. Sullivan, Brookfield, both of Ill.

[73] Assignees: W. R. Grace & Co., Duncan, S.C.; Hooper, Inc., Elmhurst, Ill.

[21] Appl. No.: 708,809

[22] Filed: July 26, 1976

[51] Int. Cl.[2] ..... B65B 31/02

[52] U.S. Cl. ..... 53/22 A; 53/12; 53/86; 53/112 A

[58] Field of Search ..... 53/7, 12, 22 R, 22 A, 53/22 B, 79, 86, 97, 112 R, 112 A, 112 B; 141/7, 66

[56] References Cited

U.S. PATENT DOCUMENTS

| | | | |
|---|---|---|---|
| 3,026,656 | 3/1962 | Rumsey | 53/22 A |
| 3,481,100 | 12/1969 | Bergstrom | 53/112 A X |
| 3,508,373 | 4/1970 | Robinson | 53/112 R X |
| 3,659,393 | 5/1972 | Richter | 53/22 A |
| 3,706,174 | 12/1972 | Young | 53/112 A X |
| Re. 27,872 | 1/1974 | Esty | 53/22 B X |

*Primary Examiner*—Travis S. McGehee

*Attorney, Agent, or Firm*—John J. Toney; William D. Lee, Jr.; John B. Hardaway

[57] ABSTRACT

A machine and method for evacuating sealed packages formed from flexible sheet material and for flushing or filling, as required, the evacuated package with an inert gas. The product enclosed within the package is preferably a food product such as luncheon meats, sausage, cheese, or the like. In constructing the package, one or more spaced apart apertures are formed in one sheet and a slit is formed in the other sheet so that preferably the slit will be on the opposite side of the package from the apertures. An initial peripheral seal is made between the two sheets to enclose the slit, apertures and product. The package is then evacuated through the slit with the sheets being separated and then the slit is sealed and gas introduced through the apertures, or, for a gas flushed package, the slit may be sealed after gas is introduced. Next the apertures are sealed thus forming a gas flushed or filled package.

24 Claims, 10 Drawing Figures

FIG. 4
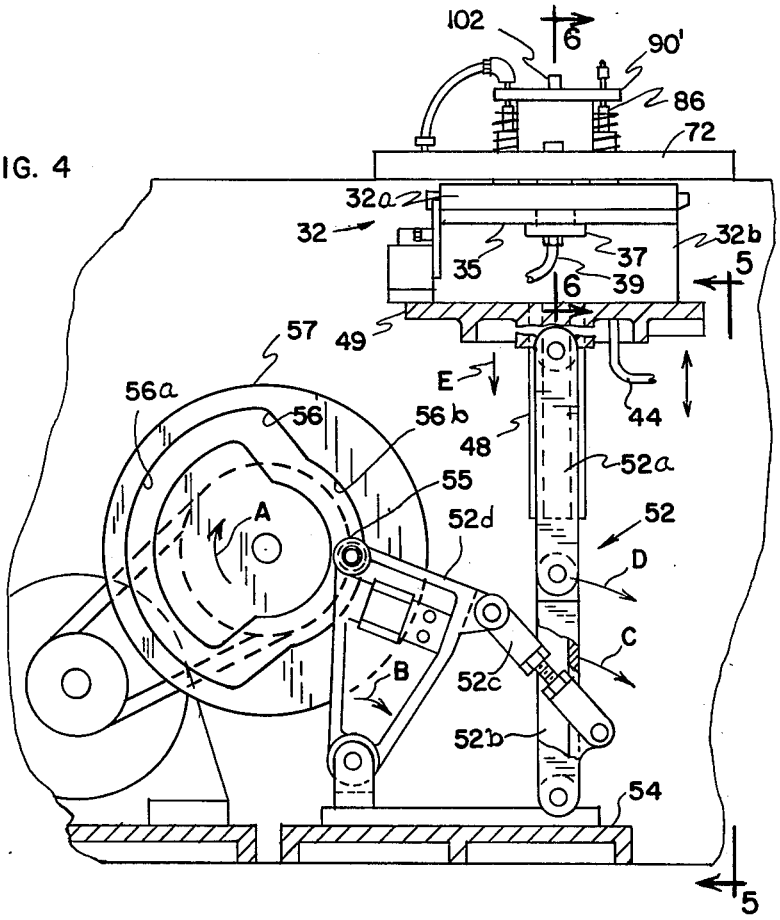
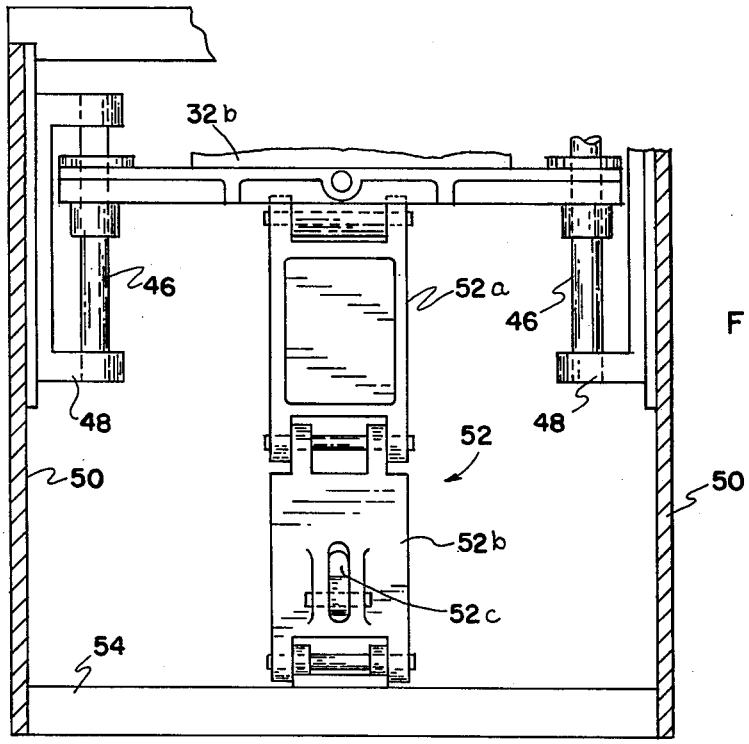
FIG. 5

32b
43
38
38
38

GAS FLUSHING OR FILLING PACKAGING MACHINE

FIELD OF THE INVENTION

This invention relates to a machine and method for preparing evacuated, gas flushed or gas filled packages from thermoplastic sheet material, preferably for food products.

BACKGROUND OF THE INVENTION

Food products and other commodities are marketed in flexible sheet material from film made of air and moisture impervious plastic, the packages being formed either from precut sections of the flexible material or from a continuous length thereof. Some of the products so marketed are adversely affected by their exposure to air for a length of time, but they retain their desired characteristics if maintained in a package from which the air has been evacuated and flushed with an inert gas to insure the removal of all air.

Various machines or procedures have been utilized to evacuate the packages of the character described after inserting into the packages the food products or other commodities. In one type of machine, the packages containing the products are fed to a vacuum chamber, the chamber is sealed and the air is evacuated from the chamber. Upon arriving at the desired vacuum, the package which has been subjected to the vacuum within the chamber is sealed off by heat sealing means. With such machines a slit must be formed in the package before the package is fed to the vacuum chamber and while in the chamber a probe must be inserted through the slit to separate the upper and lower portions of the flexible package so that air can be evacuated and gas can be introduced. One drawback to this method of forming an evacuated package is that the upper and lower film webs are separated only in the vicinity of the probe leaving air trapped in the portions of the package which are remote from the slit. Accordingly, it is one object of the present invention to produce a gas flushed package without the necessity for using a probe.

Another drawback in prior art packages is that the evacuation of air and introduction of gas is done through a single opening or orifice so that there is not a complete sweep of the package by the removal of air and introduction of gas. Accordingly, it is another object of the present invention to evacuate a package from one side thereof and introduce gas from the other side thereby completely sweeping the package of residual air.

To be commercially attractive, the packaging machines and methods must be able to attain a sustained rate of production that makes the method economically feasible. However, when higher production speeds are attempted or attained it is often at the expense of package quality so that residual air remains within the package and the sealing of the package is distorted and wrinkled thereby being both unattractive and not securely sealed. Accordingly, there is still another object of the present invention to attain high vacuum levels within a package and distortion-free seals at commercially acceptable production rates.

These and other objects are achieved by the present invention which is described in the summary of invention below.

SUMMARY OF THE INVENTION

In one aspect the present invention is a method for preparing a gas filled or flushed package wherein a product is sealed between two sheets of polymeric materials by withdrawing air from an opening in one sheet and introducing gas into the package through an opening in the other sheet.

In another aspect, the subject invention is a method of preparing a gas flushed package by forming one or more apertures adjacent an edge of a first sheet of polymeric material; forming an opening adjacent an edge of a second sheet of polymeric material; placing a product between said first and second sheets; sealing said first and second sheets together in a peripheral seal to enclose said product therebetween, said opening and said apertures being inside said peripheral seal; separating said first and second sheets whereby said sheets contact each other only at said peripheral seal; evacuating the enclosed space between said sheets through the opening in the second sheet; sealing the opening in the second sheet; introducing gas into said evacuated space through the apertures in the first sheet either prior to or subsequent to the sealing of the opening in the second sheet; and, sealing the apertures in the first sheet thereby forming a gas flushed or gas filled package.

In still another aspect, the present invention is an apparatus for preparing gas flushed packages which comprises means for sealing two thermoplastic sheets together around the periphery of the product enclosed therebetween to form a package; means for separating said sheets in the interior of said package except in the area where the sheets are sealed together; means for evacuating said package through an opening in one of the sheets while said sheets are separated; means for sealing said opening; means for introducing gas through apertures in the other sheet, said apertures being located on the side of said package opposed to said opening; and, means to seal said apertures.

DESCRIPTION OF THE DRAWINGS

The subject invention may be better understood by reference to the drawings which are appended hereto and made a part of this disclosure in which:

FIG. 4 is a vertical section taken generally along line 4—4 of FIG. 3;

FIG. 5 is a vertical section taken generally along the line 5—5 of FIG. 4;

DETAILED DESCRIPTION OF THE PREFERRED EMBODIMENT

Figure 1:
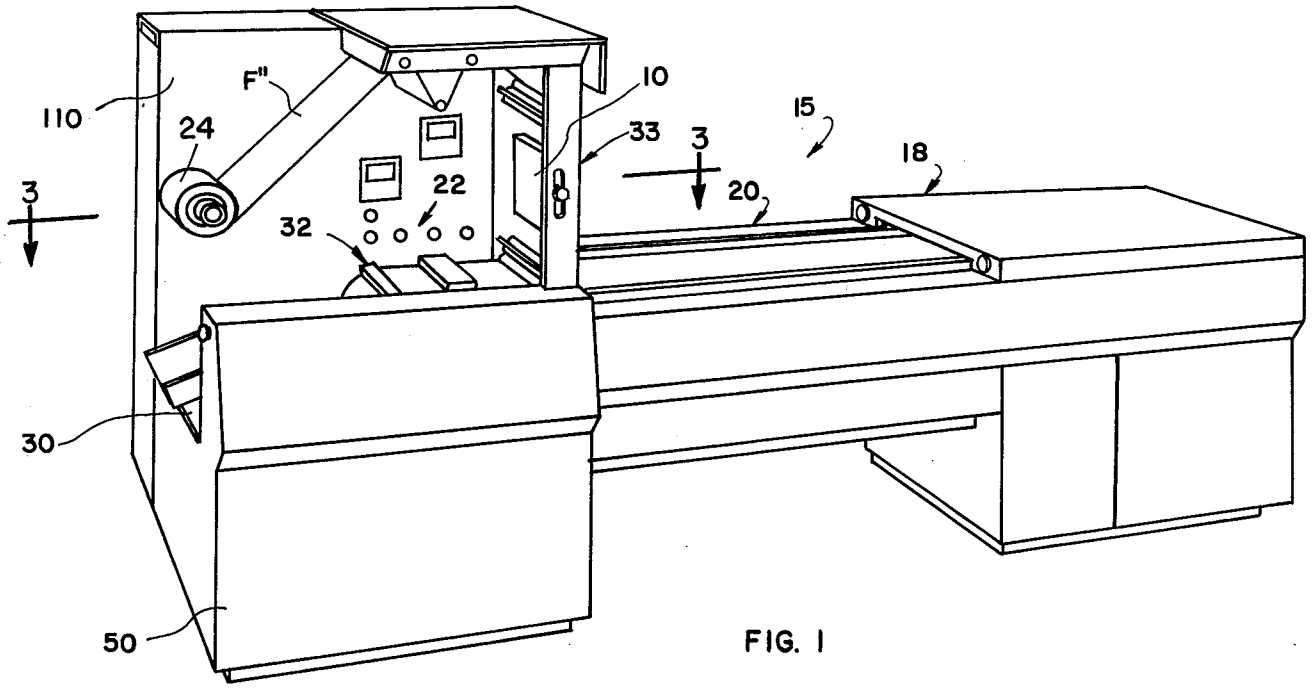
FIG. 1 is a perspective view of a packaging machine or apparatus embodying the concepts of the present invention.
Figure 2:
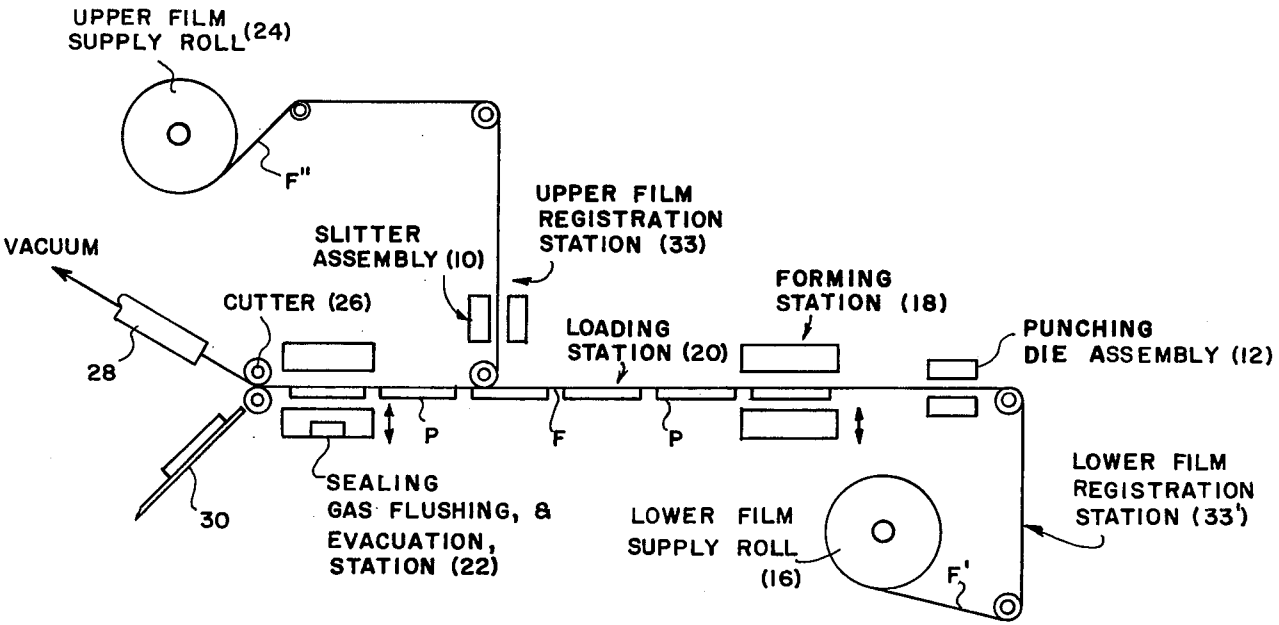
FIG. 2 is a schematic elevational view illustrating the parts of the apparatus and arrangement of the stations of the packaging machine or apparatus shown in FIG. 1.
Figure 3:
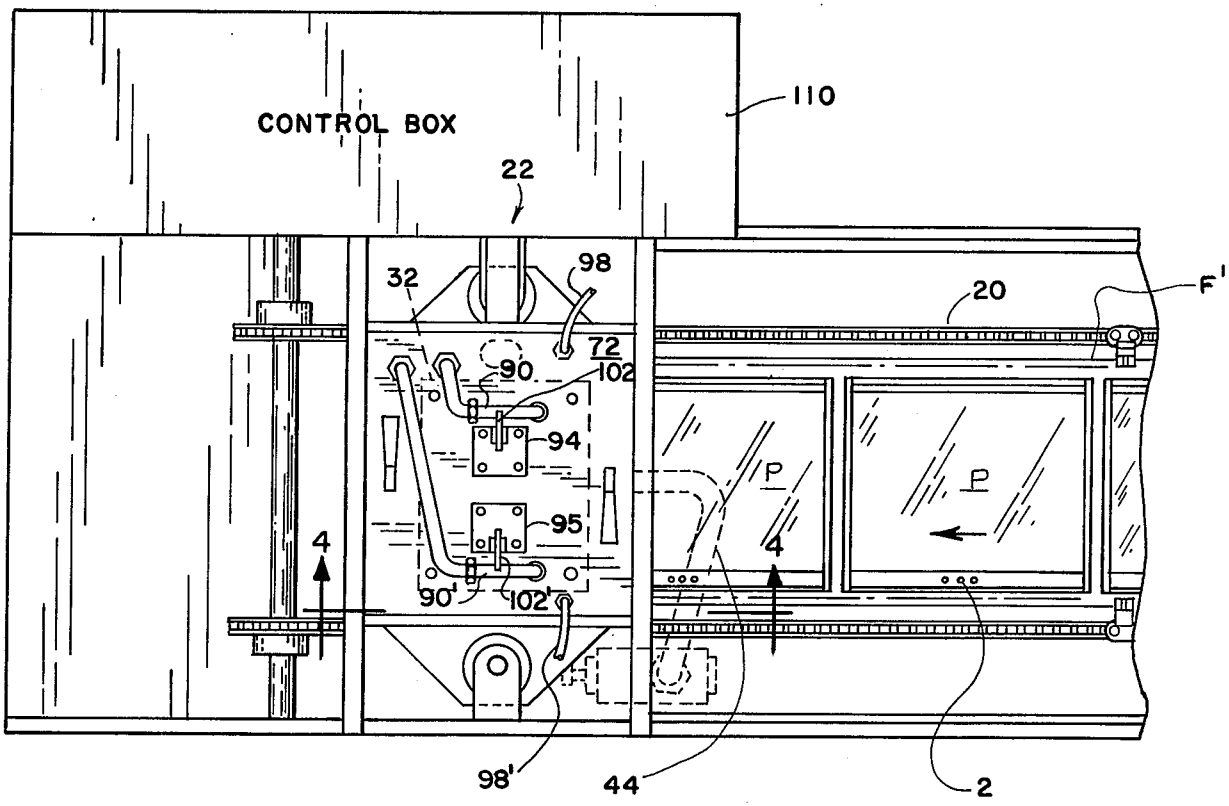
FIG. 3 is a partial plan view of the machine, on an enlarged scale, taken generally along the line 3—3 of FIG. 1.

Referring to the drawings in greater detail, and first to FIGS. 1 and 2, a packaging machine or apparatus, generally designated 15 in FIG. 1, is shown and is designed to package food products or other commodities in packages formed from flexible sheet material or film which is capable of being heat sealed about the product. Referring to FIG. 2, a first film web or continuous film F′ is stripped off of lower supply roll 16 of heat sealable and preferably thermoformable flexible material and is carried successively to punching die assembly 12 where appertures are formed adjacent an edge of the film and then to forming station 18 where individual pockets P are formed in the film for receiving a product to be packaged, then to loading station 20 where the product is loaded or positioned in the pockets P, normally by hand, and then to sealing, gas flushing, and evacuation station 22. A second thermoplastic film web or continuous sheet or layer of film F″ is carried from an upper film supply roll 24 of heat sealable flexible material to slitter assembly 10 where a slit is made adjacent an edge of the film and parallel to the edge and then to a point between the loading station 20 and the sealing, gas flushing, and evacuation station 22 to overlie the lower film sheet F′ and the pockets P formed therein with the product loaded in the pockets. The juxtaposed lengths of film are then carried to the sealing, gas flushing, and evacuation station 22 where the sheets are heat sealed together about the periphery of each pocket P and air is evacuated from within the pocket through the slit in film F″. Gas is introduced through apertures in the film F′ after which the package is sealed. The sealed pockets are then carried to a cutter 26 where the webs of film between the individual pockets are cut. The waste film is carried from a cutting station by a vacuum nozzle 28 and the severed, filled, and sealed packages are carried therefrom by conveyor 30.

Should either the upper or lower sheets of film F″ or F′ respectively, be printed along the length thereof, for each package film registration means or stations 33 for the upper sheet of film and 33′ for the lower sheet of film F′ may be provided to index the film so that the printing thereon is properly aligned with the apertures made by the punching die assembly, the slits in the upper film, and the forming station.

The present invention deals primarily with a new and improved apparatus at the sealing, gas flushing, and evacuation station 22 for sealing and upper and lower film webs together about each individually loaded pocket P and for evacuating air from within the sealed pocket and flushing residual air from the package before final sealing.

Figure 6:
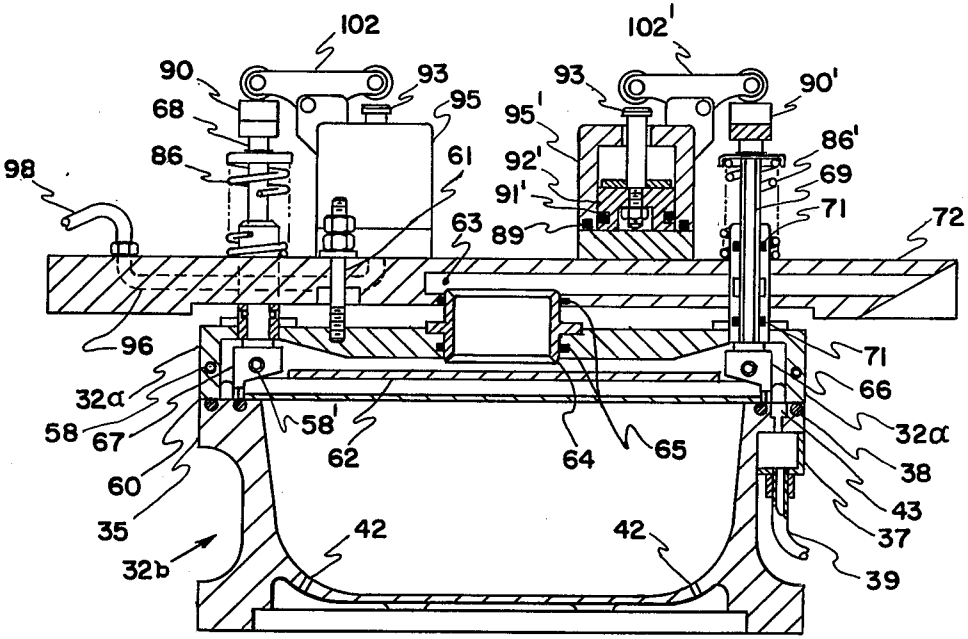
FIG. 6 is a vertical section taken generally along the line 6—6 of FIG. 5.

Referring now to FIGS. 3 through 7, the apparatus at the sealing, gas flushing, and evacuation station 22 includes a heat sealing device generally designated 32 mounted on the frame of the machine 15 and having upper and lower sections **32*a* and 32*b*, respectively. The two sections 32*a* and 32*b* of the heat sealing device are disposed opposite each other as best seen in FIGS. 4 and 6 and the lower section of 32*b* is vertically reciprocal relative to the upper section 32*a*** by means described in greater detail hereinafter.

The lower section **32*b* of heat sealing device 32 in the embodiment of the invention illustrated in the drawings has a cavity for receiving pockets P which are cavities formed in the lower sheet of film F′ at the forming station 18 which substantially conform to the shape of the cavity in the lower section 32*b*. The pockets will have been loaded with the product at the loading station 20 by the time they reach the heat sealing device. The lower section 32*b* is generally rectangular in shape and has resilient insert members 38, 38′, and 38″ about the upper peripheral edges thereof. The resilient insert members 38, 38′, and 38″ serve as first, second, and third sealing surfaces respectively and the sealing surfaces act as backing members to facilitate heat sealing of the two sheets or layers of film together when the lower section 32*b* is moved upwardly into engagement with the upper section 32*a*** which comprises a heating section as described in greater detail hereinafter.

The lower section **32*b* of the heat sealing device 32 has interior passages 42 in the base thereof in communication with vacuum hose or conduit 44** which is connected to an appropriate vacuum source for applying suction to a lower sheet of film F′ to grip the film during air evacuation of the packages as required.

FIGS. 4 and 5 show the means for mounting the lower section **32*b* of the heat sealing device 32 for vertical reciprocal movement into and out of engagement with the upper section 32*a* of the heat sealing device 32. The lower section 32*b* is journaled on vertical shafts 46 be urged in the direction opposite that described above, causing the lower section 32*b* of heat sealing device 32 to move into engagement with the upper section 32*a***.

Referring particularly to FIG. 6, the upper section **32*a* of the heat sealing device 32 comprises a heating and suction head to effect a seal between the layers for film sheets F′ and F″ about the pockets P formed therein, and for evacuating the air from between the sealed sheets. More particularly, the upper section 32*a* of the heat sealing device 32 is fabricated of heat conductive material and has an electrical heating element 58 embedded therein so as to distribute the heat from the heating elements 58 throughout the body of the upper section 32*a***.

The heating element 58 is connected through an electrical cable and conduit which are not shown to an appropriate electrical source. To facilitate a heat seal, the upper section **32*a* has a downwardly depending lip 60 about the periphery thereof and overlying the resilient insert member or sealing surface 38 in the lower section 32*b*. Thus, it can be seen that as the rotatable cam 57 moves the lower section 32*b* upwardly toward the upper section 32*a*, the juxtaposed sheets of film F and F″ will be sandwiched between the sections of the heat sealing device and will be heat sealed in the areas defined by heat sealing surface or lips 60 of the upper section 32*a* and the resilient insert member 38 or first sealing surface of the lower section 32*b***.

Still referring to FIG. 6 and the description of the upper section **32*a* of the heat sealed device, mounting block 72 (See also FIGS. 3 and 4) is shown in cross-section, and vacuum duct 63 in mounting plate 72 is shown in communication with evacuation port 64 which is centrally located in upper section 32*a* and allows vacuum communication with the interior of the heat sealing device. Seals 65 in which form part of mounting brackets 48 secured to the side wall portions 50 of the frame of the packaging machine 15. A linkage structure, generally designated 52 is disposed between the lower section 32*b* of the heat sealing device and the bottom wall portion 54 of the frame of the packaging machine 15. The linkage structure has four link members 52*a* through 52*d* which effect vertical movement of the lower section 32***b* in response to rotation of cam member 57 (See FIG. 4). The link 52*a* is elongated, is pivotally connected at one end thereof to the underside of the lower section 32*b*, and is pivotally connected at the other end thereof to one end of elongated link 52*b*. The other end of link 52*b* is pivotally connected to the bottom wall portion 54 of the machine frame. Link member 52*c* also is elongated, is pivotally connected at one end thereof intermediate of ends of the link 52*b*, and is pivotally connected at the other end thereof to link 52*d* which is triangularly shaped. One corner of the triangularly shaped link 52*d* is connected to link 52*c*, another corner thereof is pivotally connected to the base wall portion 54, and the third corner thereof has a roller member 55 positioned in a slot 56 of a cam member 57. The cam slot 56 has a "rise" portion 56*a* and a "fall" portion 56*b*. Thus, as the cam member 57 is rotated in the direction of arrow A, for instance, the rise portion 56*a* of the cam slot 56 pivotally cams the link 52*d* in the direction of arrow B (FIG. 4). The link 52*d*, through the link 52*c*, will cause the link 52*b* to pivot about its connection to the base wall portion 54 in the direction of arrow C. The link 52*b* in turn causes the lower end of link 52*a* to move outwardly in the direction of arrow D to pull the lower section 32*b* of the heat sealing device 32 downwardly in the direction of arrow E away from and out of engagement with upper section 32*a* when the roller member 55 on the triangularly shaped link 52*d* moves back into the "fall" position 56*b* of cam slot 56, as seen in FIG. 4, the links 52*a* to 52*d* will both mounting blocks 72 and upper section 32*a* insure a vacuum tight seal. Immediately below port 64 is expansion control plate 62 which does not extend the full width and length of the interior of the upper section of 32*a* and is for the purpose of controlling the expansion of the upper film F″ when it is separated under the influence of the vacuum to port 64. This keeps the upper film F″ from being stretched beyond its elastic limit and control plate 62 also serves the function of preventing the film F″ from blocking and clogging evacuation port 64. Spaced apart from the control plate 62 are vertically reciprocating sealing bars 66 and 67. Each of these sealing bars is vertically reciprocated by a similar mechanism which is carried on mounting plate 72. The essential drive is a rocker arm type where the driving force is supplied by the piston 92′ of pneumatic cylinder 95′ and the compressed air to drive the piston is supplied through a passageway such as 96 which is supplied by conduit 98. Cylinder seal ring 89 provides a hermetic closure for the cylinder 95 and piston ring 91′ further insures a seal between the cylinder wall and the piston 92′. As the piston 92′ is forced upwardly under the influence of compressed air supplied through passage 96, the drive rod 93 pushes lever member 102′ or rocker arm upwardly and, since the lever 102′ is pivotally mounted, as its left end is forced upwardly the right end correspondingly moves downwardly exerting force on connecting bar 90′ which is connected to push rod 69 which will force the gas port sealing bar 66 downwardly and against the sealing member or second sealing surface 38′ (See FIG. 7). Seals 71 prevent loss of air pressure from within the sealing device and spring 86′ returns the seal bar 66 to its original position after the supply of compressed air is shut off to cylinder 95′ and the cylinder is vented to atmosphere. The drive for the evacuation slit sealing bar 67 works similarly and seal bar 67 is reciprocated into an out of contact with the seal surface 38′ (See FIG. 7) in the same manner as seal bar 66 is reciprocated with respect to the sealing surface 38″. Each sealing bar is provided with an electrically resistance heated sealing element 58′ and the sealing bars are constructed from heat conductive material so that the tip of the bar can be maintained at the appropriate sealing temperature in order to seal the film webs F′ and F″ together.

Figure 7:
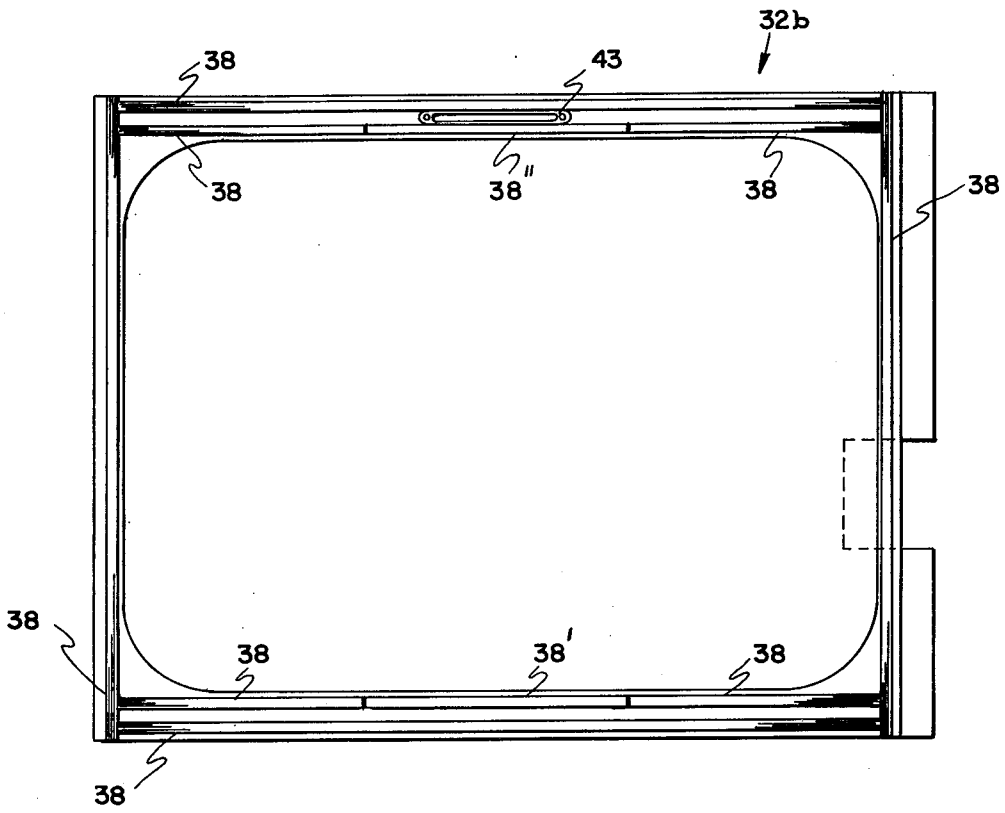
FIG. 7 is a top plan view of the lower section of the sealing device which is a part of the packaging machine of the subject invention; and, FIGS. 8, 9, and 10 are sequential schematic views of a vertical section taken generally along the line 6—6 of FIG. 4 showing the position of the product, film, and sealing members during the evacuation, gas flushing, and sealing of a package according to the method of the present invention.

Referring now to FIGS. 6 and 7, lower section 32*b* will be described in more detail. FIG. 6 shows lower section 32*b* in cross-section and FIG. 7 is a top plan view looking down into the cavity of section 32*b*. FIG. 7 has peripheral sealing surface 38 which surrounds the cavity of 32*b* and is a resilient member for sealing film F′ and F″ together in a continuous, hermetic seal to enclose a product which has been placed in the pocket of the lower film F′. Four inner segments of member 38 are also shown. A second sealing surface is designated 38′ and it is in line with two of the inner segments of member 38. Surface 38 is contacted by sealing bar 67 to seal off the slit in the upper film F″. A third sealing surface 38″ is provided in line with the other two inner segments of member 38 and surface 38″ seals off the gas introduction ports or apertures in the lower film F′ when seal bar 66 is lowered. Slot shaped gas inlet port 43 is located between the first and third sealing surfaces 38 and 38″ and the slot 43 is in communication with manifold 37 which is connected to gas line 39. Through the gas line an inert gas such as nitrogen or the like can be introduced into the interior of the package at the appropriate time as will be more fully described hereinafter.

The operation of the apparatus and method of the subject invention will be now described with particular reference to FIGS. 2, 8, 9 and 10. After the two continuous sheets or layers of film from the upper and lower supply rolls thereof have passed through the forming and loading stations and have reached the sealing and evacuation station with pockets P formed in the lower sheet of film F′ loaded with the product and with the upper sheet of film disposed in juxtaposed position above the lower sheet, the sealing and evacuating process of the present invention is as follows. The lower section 32*b* of the sealing device 32 is raised by means of the linkage structure 52 and the cam 57 (FIGS. 4 and 5) into sealing position beneath the upper section 32*a* with the sheets of film sandwiched between the sealing surface 60 on the upper section 32*a* and the sealing surface 38 in the lower section 32*b*. The sheets of film with the pocket P in the lower sheet thereof within the cavity of the lower section 32*b* thus are sealed about the periphery thereof. Suction is then applied to the lower sheet of film F′ through the vacuum hose 44 and passages 42 at the underside of the lower section of 32*b* to grip the lower sheet of film. Suction is next applied through the vacuum duct 63 and evacuation port 64 to cause the upper sheet to move upwardly toward expansion control plate 62. The suction on the upper sheet is continued to exhaust the air between the two sealed sheets through the slit in the upper sheet which can be seen in the left hand portion of FIG. 8 where an arrow is located in the passageway between evacuation slit sealing bar 67 and the outer wall of the upper section 32*a* to exhaust the air from between the two seal sheets and thereby remove air from the interior of the package.

Figure 8:
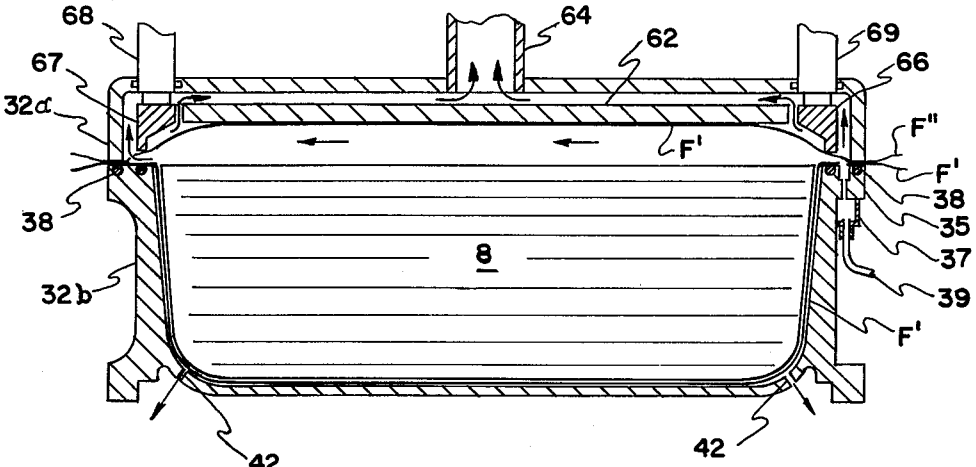
Figure 9:
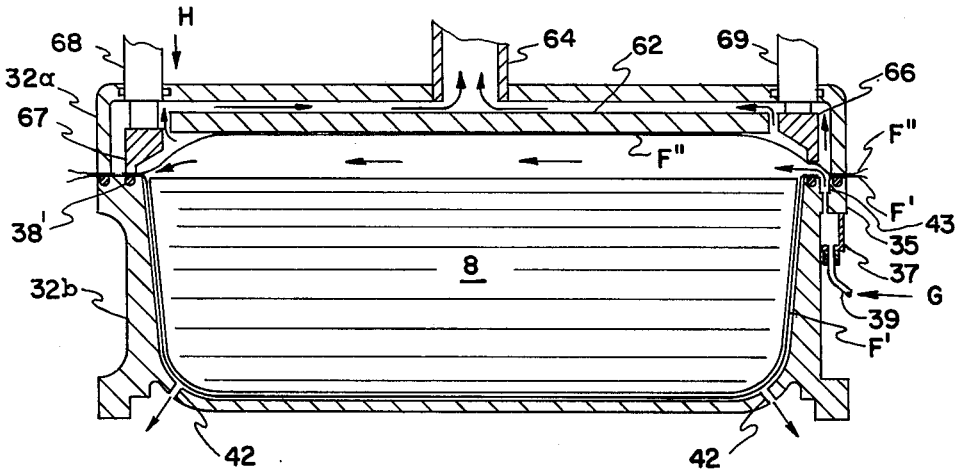
Figure 10:
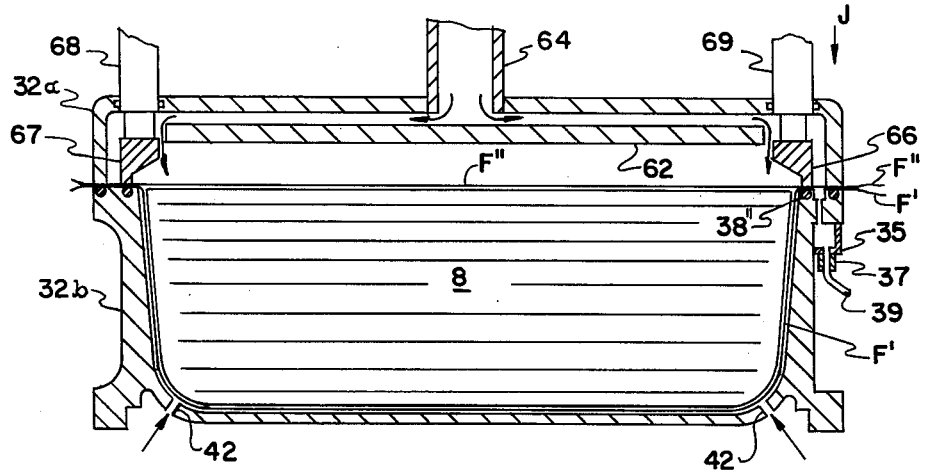

Following the evacuation of the package interior as shown in FIG. 8, compressed air is introduced through conduit 98 (See FIG. 6) and thence to pneumatic cylinder 95 where the piston within the cylinder is forced upwardly to actuate lever 102 and drive push rod 68 downwardly in the direction of arrow H in FIG. 9 thereby lowering sealing bar 67 against second sealing surface 38' to seal and close the slit. During the sequence of operations represented by FIG. 8 the gas line 39 has been closed by a valve (not shown) so that the package interior where the product 8 is located has been sealed from the atmosphere. (Alternately, gas could be introduced before the slit is sealed to flush the package interior.) Subsequently, as shown in FIG. 9, gas is introduced through line 39 as represented by the arrow G and enters the package interior through manifold 37 and port 43. The top view of port 43 as shown in FIG. 7 and the location of the apertures 2 in the lower film F' can be seen in FIG. 3 where the lower film is held by chain grippers as the pockets P in the film approach the sealing, gas flushing, and evacuation station 22. As the gas is admitted into the space between the film sheets it rapidly sweeps the space and fills the package. After a sufficient quantity of gas has been admitted, pneumatic cylinder 95' is actuated thus forcing push rod 69 downwardly in the direction of arrow J in FIG. 10 thereby forcing gas port sealing bar 66 downwardly against the third sealing surface 38'' to close off the apertures in the lower film F' from further introduction of gas and from the atmosphere. Simultaneously with the sealing of the apertures, the vacuum that had been applied through port 64 is shut off and atmospheric air is introduced which drives the upper film F'' downwardly towards product 8. At this point a completely sealed and gas filled package has been made and the lower section **32*b* can be lowered so that the package can move forward toward the cutter as shown in FIG. 2** and be separated from the continuous sheets of film F' and F''.

A control box 110 (FIGS. 1 and 2) is disposed behind the sealing, gas flushing, and evacuation station 22 and houses control means including an appropriate conventional electrical cam, appropriate conventional solenoid operated air and vacuum valves, an appropriate pneumatic and electrical circuitry to control the timing of the vacuum of the lower section **32*b* of the heat sealing device, the vacuum for the upper section 32*a*, and the air pressure applied to the pneumatic cylinders 95 and 95'. The electrical cam is synchronized with the cam 57**. A preferred arrangement for the setting of the lobes of the electrical cam to actuate the respective functions as the cam rotates in a representative 360° cycle is shown in the table below:

TABLE I

| FUNCTION | ON | OFF |
|---|---|---|
| Lower Section Vacuum Through Port 42 | 35° | 190° |
| Upper Section Vacuum Through Port 64 | 40° | 190° |
| Evacuation Slit Seal Bar 67 Lowered | 150° | 195° |
| Gas Port Sealing Bar 66 Lowered | 175° | 195° |
| Gas Flushing Option | 140° | 175° |
| Gas Filling Option | 150° | 175° |

It has been found that a series of two or more apertures or holes in the flange area or sealing margin area of the lower or thermoformed film web provide a more stable and distortion-free type of opening through which to introduce gas rather than enlarging a single aperture, particularly when the apertures are disposed in line above a corresponding slot-shaped port. Likewise, a slit which is placed in the flexible film F' so that it will be on the opposite side of the package as the apertures has been found to be a preferred opening through which the package can be evacuated and at the same time sealed.

In one preferred embodiment of the subject invention a cavity or pocket size of 12" × 17⅞" × 5" deep has been used to package smoked sausage at vacuum levels of greater than 25 in.Hg. with a machine speed of 15 packages per minute. Nitrogen gas was used as the filling gas. In this embodiment the apertures which are punched in the film F' at punching die assembly 12 (See FIG. 2) are preferably ¼ inch diameter holes spaced on ½ inch centers with three holes per set and the slit is 5⅜ inches long.

The foregoing is a description of a preferred embodiment of apparatus and method of our invention, and having thus described our invention,

We claim:

1. In the method of preparing a gas filled or flushed package from two sheets of polymeric material, one sheet having an opening formed therein and the other having an aperture formed therein, the improvement which comprises:

a. sealing said sheets together in a continuous peripheral seal to enclose a product therebetween thereby forming a package, said aperture and opening being on opposed sides of said product and within said peripheral seal;
b. withdrawing air from the package through an opening in one sheet;
c. introducing gas into said package through an aperture in the other sheet; and,
d. sealing said aperture and said opening.

2. The method of claim 1 wherein said aperture and said opening are on different sides of said package.

3. The method of claim 1 wherein said aperture and opening are on opposed sides of said package.

4. A method of preparing a gas flushed or filled package having a product hermetically sealed between two sheets of polymeric material comprising the steps of:

a. forming at least one aperture adjacent an edge of a first sheet of polymeric material;
b. forming an opening adjacent an edge of a second sheet of polymeric material.
c. placing a product between said first and second sheets;
d. sealing said first and second sheets together in a peripheral seal to enclose said product therebetween;
e. separating said first and second sheets whereby said sheets contact each other in the package interior only at said peripheral seal,
f. evacuating the space between said sheets enclosed by said peripheral seal through the opening in the second sheet;
g. sealing and opening in the second sheet;
h. introducing gas into said evacuated space through the aperture in the first sheet; and,
i. sealing the aperture in the first sheet.

5. The method of claim 4 including the step of forming a plurality of apertures in the first sheet in a line parallel to the edge of the sheet.

6. The method of claim 4 wherein said opening and said aperture are on different sides of said product.

7. The method of claim 4 wherein gas is introduced into said evacuated space prior to sealing the opening in the second sheet.

8. The method of claim 4 wherein said sheets are separated by reducing the pressure on the exterior surface of each sheet.

9. A method of preparing a gas flushed or filled package comprising the steps of:

a. providing a relatively flexible thermoplastic covering sheet;
b. forming an opening adjacent an edge of said covering sheet;
c. providing a thermoformable sheet;
d. forming a plurality of apertures in a line adjacent and parallel to an edge of said thermoformable sheet;
e. forming a product receiving cavity in said formable sheet with a peripheral flange around the opening to said cavity, said apertures being in said flange;
f. placing a product in said cavity;
g. covering said cavity with the covering sheet so that said opening and said apertures are on opposed sides of said product;
h. sealing said covering sheet to the flange of said formable sheet in a peripheral seal so that said opening and apertures are inside said seal thereby creating a sealed space enclosing said product;
i. reducing the air pressure on the outside of the covering sheet and the formable sheet to separate said sheets except in the area where they are sealed together;
j. evacuating the sealed space enclosed by said sheets through said opening;
k. sealing said opening;
l. introducing gas into said sealed space through said apertures; and, thereafter,
m. sealing said apertures.

10. The method of claim 9 wherein gas is introduced into said sealed space prior to the sealing of said opening.

11. The method of claim 9 wherein said product is a food product.

12. The method of claim 9 wherein the opening in the flexible sheet is formed in the shape of a slit.

13. The method of claim 9 wherein the apertures formed in said thermoformable sheet are circular.

14. The method of claim 9 wherein said method is performed continuously.

15. Apparatus for preparing gas flushed or filled packages comprising:

a. means for sealing two thermoplastic sheets together around the periphery of a product enclosed between said sheets to form a package;
b. means for separating said sheets in the interior of said package except in the area where said sheets are sealed together by the sealing means of subparagraph (a);
c. means for evacuating said package through an opening in one of the sheets while separated;
d. means for sealing said opening;
e. means for introducing gas through an aperture in the other sheet; and,
f. means to seal said aperture.

16. Apparatus according to claim 15 including means for forming a product receiving cavity in the thermoplastic sheet containing said aperture.

17. The aperture of claim 15 wherein the means for separating said sheets are means for reducing the pressure on the exterior surface of each sheet.

18. The apparatus of claim 15 wherein said means for introducing gas includes are slot-like gas inlet port aligned with said aperture.

19. Apparatus for preparing gas flushed or filled packages from two thermoplastic webs comprising:

A. A sealing device including upper and lower sections which, when closed together with said thermoplastic webs engaged therebetween, form a gas-tight enclosure,
   1. said lower section having a cavity for receiving a first thermoplastic web member and said lower section including:
      a. a first sealing surface for forming a continuous seal around the opening to said cavity;
      b. a second sealing surface disposed inwardly of said first surface for sealing an opening in a second thermoplastic web;
      c. a third sealing surface disposed inwardly of said first surface for sealing an aperture in said first thermoplastic web; and,
      d. gas port means disposed between said first and third surfaces; and,
   2. said upper section having:
      a. a first sealing member including heating means, said first sealing member being shaped to contact said first sealing surface around the periphery of said cavity;
      b. a second sealing member for sealing an opening in said second web, said second member including heating means and means to vertically reciprocate same when said sealing device is closed into and out of contact with said second sealing surface;
      c. a third sealing member for sealing apertures in said first web, said third member including heating means and means to vertically reciprocate same into and out of contact with said third sealing surface when said sealing device is closed;
      d. vacuum port means for the application of vacuum to lift said second web and simultaneously evacuate the space between said webs;
B. Means for raising and lowering the lower section of said sealing device;
C. Vacuum means for withdrawing air through said vacuum port means; and,
D. Gas supply means for introducing gas to the space between said webs through said gas port means.

20. The apparatus of claim 19 including means to retain said first web within the cavity of said lower section.

21. The apparatus of claim 19 including two pneumatically driven rocker arm means to vertically reciprocate said second and third sealing members respectively.

22. The apparatus of claim 19 including a forming station to form a cavity in said first web which substantially conforms to the cavity in the lower section of the sealing device.

23. The apparatus of claim 19 including means to form apertures adjacent an edge of said second web, said apertures being so spaced as to be alignable over said vacuum port means.

24. The apparatus of claim 19 including means to form an opening adjacent an edge of said second web.

* * * * *

UNITED STATES PATENT OFFICE

CERTIFICATE OF CORRECTION

Patent No. 4,058,953 Dated November 22, 1977

Inventor(s) Philip A. Sanborn, Jr., et al

It is certified that error appears in the above-identified patent and that said Letters Patent are hereby corrected as shown below:

Claim 4, subparagraph g. Delete the word, "and," and in its place insert the word, -- the --.

Claim 17, first line. Delete the word, "aperture," and insert in its place the word, -- apparatus --.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*